United States Patent [19]

Saito et al.

[11] 4,043,382

[45] Aug. 23, 1977

[54] METHOD AND APPARATUS FOR CONTINUOUSLY CASTING STEEL

[75] Inventors: Katashi Saito; Toshio Matsumoto; Nobuhisa Hasebe; Tatsuo Kobatake, all of Yokohama, Japan

[73] Assignee: Nippon Kokan Kabushiki Kaisha, Tokyo, Japan

[21] Appl. No.: 639,064

[22] Filed: Dec. 9, 1975

[30] Foreign Application Priority Data

Jan. 13, 1975 Japan ..... 50-5549

[51] Int. Cl.[2] ..... B22D 11/12

[52] U.S. Cl. ..... 164/76; 164/270; 164/282

[58] Field of Search ..... 164/82, 89, 76, 282, 164/270

[56] References Cited

U.S. PATENT DOCUMENTS

| | | | |
|---|---|---|---|
| 3,290,741 | 12/1966 | Olsson | 164/82 |
| 3,656,536 | 4/1972 | Colombo | 164/89 |
| 3,680,623 | 8/1972 | Tarmann et al. | 164/82 X |
| 3,893,503 | 7/1975 | Eibl | 164/282 |
| 3,908,744 | 9/1975 | Fastner | 164/82 |
| 3,974,559 | 8/1976 | Kawawa et al. | 164/82 X |

*Primary Examiner*—Robert D. Baldwin
*Attorney, Agent, or Firm*—Flynn & Frishauf

[57] ABSTRACT

In a type of continuous casting of steel in which a straight mold is employed and a cast strand is guided while being bent, molten steel is continuously teemed into said straight mold; an unsolidified cast strand with a solidified shell formed on it is guided substantially vertically downward within a range from 3 to 7m from the meniscus of molten steel in said straight mold; then, said unsolidified cast strand being in the vertical position is guided within a range from 1 to 4m while being bent at multiple points by gradually decreasing the radius of curvature of said cast strand for each of successively arranged pairs of bending rollers; then the solidification of said unsolidified cast strand thus bent at multiple points is completed before a spot-straightening point while further guiding said cast strand along a constant curvature, the track length of said constant curvature guide being within a range from 35 to 85% of the length from said meniscus of molten steel in said straight mold up to said spot-straightening point; then, said cast strand is reduced, near its solidification completing point, at a draft of 0.1 to 2.0% per pair of reduction rolls; and then, said reduced cast strand is straightened in a substantially horizontal direction at a single point at said spot-straightening point; whereby a continuously cast strand free from or with remarkably decreased inner and outer defects is obtained.

6 Claims, 2 Drawing Figures

METHOD AND APPARATUS FOR CONTINUOUSLY CASTING STEEL

FIELD OF THE INVENTION

The present invention relates to improvements in a method and an apparatus for continuously casting steel in which a straight mold is employed and a cast strand is guided while being bent.

BACKGROUND OF THE INVENTION

The following six types of method for continuously casting steel are conventionally known:

1. The single-curvature/spot-straightening type, using a curved mold, which comprises casting steel in said curved mold, guiding an unsolidified cast strand with a solidified shell formed on it while bending said cast strand along a curvature having the same radius as that of said curved mold, then accelerating and completing the solidification of said unsolidified cast strand while straightening said cast strand thus bent in a substantially horizontal direction at a single point, and cutting and transporting said cast strand completely solidified in the horizontal position;

2. The infinite-point bending/gradual-straightening type, using a curved mold, which comprised casting steel in said curved mold, guiding to some extent an unsolidified cast strand with a solidified shell formed on it while bending said cast strand along a curvature having the same radius as that of said curved mold, then accelerating and completing the solidification of said unsolidified cast strand while gradually straightening said cast strand thus bent in a substantially horizontal direction by increasing the radius of curvature of said unsolidified cast strand thus bent at multiple points or at infinite points, and cutting and transporting said cast strand completely solidified in the horizontal position;

3. The fully vertical type, using a straight mold, which comprises casting steel in said straight mold, accelerating and completing the solidification of an unsolidified cast strand with a solidified shell formed on it in the vertical position while guiding said unsolidified cast strand substantially vertically downward, cutting said completely solidified cast strand in the vertical position, and then transporting it;

4. The vertical-solidification/single-curvature/spot-straightening, using a straight mold, which comprises casting steel in said straight mold, accelerating and completing the solidification of an unsolidified cast strand with a solidified shell formed on it in the vertical position while guiding said unsolidified cast strand substantially vertically downward, bending said completely solidified cast strand at a constant radius of curvature from the vertical position, then straightening said cast strand in a substantially horizontal direction at a single point, and then cutting and transporting said cast strand in the horizontal position;

5. The vertical-unsolidification/single-curvature/-spotstraightening type, using a straight mold, which comprises casting steel in said straight mold, guiding to some extent an unsolidified cast strand with a solidified shell formed on it substantially vertically downward, then bending said unsolidified cast strand at a constant radius of curvature from the vertical position, accelerating and completing the solidification of said unsolidified cast strand while straightening said cast strand in a substantially horizontal direction at a single point, and cutting and transporting said completely solidified cast strand in the horizontal position;

6. The vertical-unsolidification/infinite-point bending/gradual-straightening type, using a straight mold, which comprises casting steel in said straight mold, guiding an unsolidified cast strand with a solidified shell formed on it substantially vertically downward within a range from 2 to 3m from the meniscus of molten steel in said straight mold, then gradually bending said unsolidified cast strand in the vertical position by successively decreasing the radius of curvature at infinite points to a constant curvature, then accelerating and completing the solidification of said unsolidified cast strand while slowly straightening it in a substantially horizontal direction by increasing said constant radius of curvature at infinite points and cutting and transporting said completely solidified cast strand in the horizontal position.

The conventional types of continuous casting of steel mentioned above involve the following problems: in types (1), (2), (5) and (6), inclusions in molten steel teemed into a mold penetrate, together with molten steel, deeply into the curved portion of an unsolidified cast strand because the unsolidified cast strand is guided while being bent. On floating up by buoyancy, inclusions are trapped on the inner surface of the curved portion of the solidified shell of the unsolidified cast strand and cannot in many cases float up completely to the meniscus of molten steel in a mold. This causes the formation of a localized zone of inclusions at a position in the interior of the completely solidified cast strand.

In types (3) and (4) mentioned above, on the other hand, a localized zone of inclusions as described above is never formed at a position in the interior of a completely solidified cast strand because the cast strand is held in the vertical position up to the completion of solidification. However, the increased height from the meniscus of molten steel in the mold up to the solidification completing point of the unsolidified cast strand, i.e., up to the crater top in the unsolidified cast strand causes increase in the static pressure of molten steel near the solidification completing point in the interior of the unsolidified cast strand. The diameter of rollers guiding the unsolidified cast strand should therefore be enlarged sufficiently to cope with this increased static pressure of molten steel. This increase in the guide roller diameter leads to a longer pitch between rollers, which in turn results in a larger amount of bulging of the unsolidified cast strand between rollers. This causes formation of a dense center segregation in the cast strand. Reduction of the cast strand at a relatively large draft near the solidification completing point in the cast strand, if applied with reduction rolls with a view to straightening this large bulging and eliminating the center segregation, produces many inner cracks on the liquid-solid interface of molten steel in the cast strand.

In types (1) and (5) mentioned above, furthermore, a cast strand is bent at a constant radius of curvature and then straightened in a substantially horizontal direction at a single point in its unsolidified state. Bending and straintening thus applied cause a too large amount of deformation strain of the cast strand, thus resulting in the formation of many surface and inner cracks.

C, Mn, S and other constituents are segregated in general in the unsolidified molten steel near the solidification completing point of a continuously cast strand. In any of types (1) to (6) mentioned above, the formation of a dense center segregation zone at the center of the cast strand cross-section is inevitable because of the bulging between rolls near the solidification completing point of the cast strand.

SUMMARY OF THE INVENTION

An object of the present invention is therefore to provide improvements in a method and an apparatus for continuously casting steel using a straight mold of the type in which a cast strand is guided while being bent, said improvements permitting prevention of inner and outer defects of the cast strand, i.e., localization of inclusions, center segregation, inner and outer cracks.

In accordance with one of the features of the present invention, there is provided a method and an apparatus for continuously casting steel, which comprises:

continuously teeming molten steel into a straight mold; guiding an unsolidified cast strand with a solidified shell formed on it substantially vertically downward along a vertical guide section comprising said straight mold and a vertical guide roller train composed of plural pairs of guide rollers, the track length of said vertical guide being within a range from 3 to 7m from the meniscus of molten steel in said straight mold, then guiding said unsolidified cast strand in the vertical position along a curved multiplepoint bending guide section comprising plural pairs of bending rollers while bending said unsolidified cast strand at multiple points by successively decreasing the radius of curvature of said unsolidified cast strand for each pair of said bending rollers, the track length of said multiplepoint bending guide being within a range from 1 to 4m, then, further guiding said unsolidified cast strand thus bent at multiple points along a constant curvature guide section comprising plural pairs of guide rollers and at least a pair of reduction rolls, the radius of curvature of said constant curvature guide section being the same as that of the tail end of said multiple-point bending guide section, and the track length of said constant curvature guide being within a range from 35 to 85% of the length from the meniscus of molten steel in said straight mold up to a spot-straightening point provided in succession to said constant curvature guide section; then, completing the solidification of said unsolidified cast strand before said spot-straightening point; then, reducing the cast strand, near the solidification completing point thereof, by at least a pair of reduction rolls forming the tail end portion of said constant curvature guide section, at a draft of 0.1 to 2.0% per pair of said reduction rolls; and then, straightening said cast strand thus reduced in a substantially horizontal direction at a single point at said spot-straightening point.

BRIEF DESCRIPTION OF THE DRAWINGS

The present invention is illustrated by way of example in the accompanying drawings which form part of this application and in which.

DETAILED DESCRIPTION OF PREFERRED EMBODIMENTS

Figure 1:
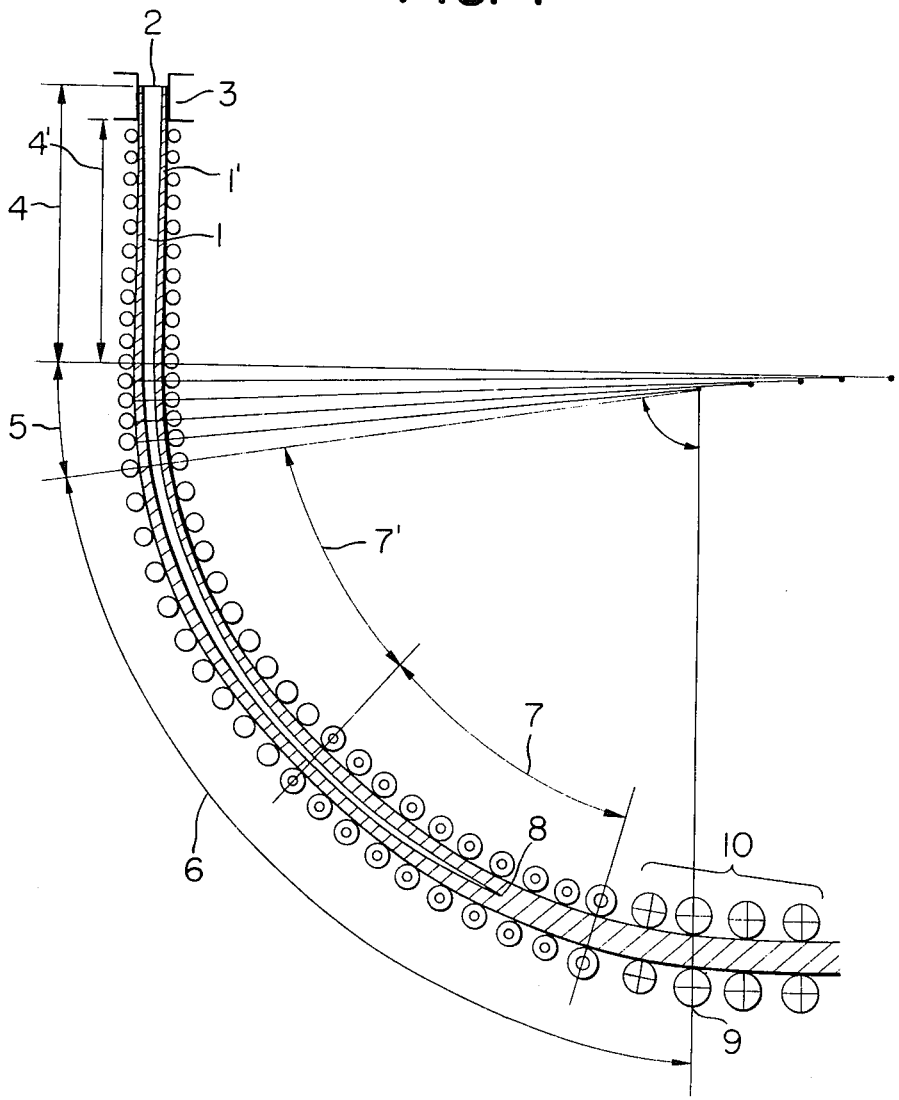
FIG. 1 is a schematic sectional view illustrating a continuous casting apparatus of steel of the present invention.

In view of the foregoing, the inventors have conducted an extensive study on a method and an apparatus which would permit prevention of inner and outer defects of a cast strand, i.e., localization of inclusions, center segregation and inner and outer cracks. They found as a result the possibility of eliminating or remarkably reducing said inner and outer defects of a cast strand as mentioned above by: continuously teeming molten steel into a straight mold; guiding an unsolidified cast strand with a solidified shell formed on it substantially vertically downward along a vertical guide section comprising said straight mold and a vertical guide roller train composed of plural pairs of guide rollers, the track length of said vertical guide being within a range from 3 to 7m from the meniscus of molten steel in said straight mold; then, guiding said unsolidified cast strand in the vertical position along a curved multiple-point bending guide section comprising plural pairs of bending rollers while bending said unsolidified cast strand at multiple points by successively decreasing the radius of curvature of said unsolidified cast strand for each pair of said bending rollers, the track length of said multiple-point bending guide being within a range from 1 to 4m; then, further guiding said unsolidified cast strand thus bent at multiple points along a constant curvature guide section comprising plural pairs of guide rollers and at least a pair of reduction rolls, the radius of curvature of said constant curvature guide section being the same as that of the tail end of said multiple-point bending guide section, and the track length of said constant curvature guide being within a range from 35 to 85% of the length from the meniscus of molten steel in said straight mold up to a spot-straightening point provided in succession to said constant curvature guide section; then, completing the solidification of said unsolidified cast strand before said spot-straightening point; then, reducing the cast strand, near the solidification completing point thereof, by at least a pair of reduction rolls forming the tail end portion of said constant curvature guide section, at a draft of 0.1 to 2.0% per pair of said reduction rolls; and then, straightening said cast strand thus reduced in a substantially horizontal direction at a single point at said spot-straightening point.

The following paragraphs explain the reasons why, in the method and the apparatus for continuously casting steel of the present invention, the vertical guide length, the multiple-point bending guide length, the length of constant curvature guide and the draft of a cast strand are limited as mentioned above, and why a cast strand is straightened in a substantially horizontal direction at a single point.

1. Vertical guide length of cast strand:

If the vertical guide length of an unsolidified cast strand with a solidified shell formed on it is under 3m, inclusions in molten steel teemed into a straight mold penetrate, together with molten steel, even into the curved portion of the unsolidified cast strand bent at the following multiple-point bending guide section and further at the following constant curvature guide section. Inclusions are therefore trapped on the inner surface of the curved portion of the solidified shell of the unsolidified cast strand on floating up by buoyancy. A localized zone of inclusions is thus formed in the interior of the cast strand after the completion of solidification. If said vertical guide length exceeds 7m, on the contrary, the too high overall height of the equipment is inconvenient. Said vertical guide length should therefore be within a range from 3 to 7m.

2. Multiple-point bending guide length of cast strand.

Following the vertical guide mentioned above, the unsolidified cast strand in the vertical position is bent at multiple points with plural pairs of bending rollers. In this bending, if the amount of strain on the inner surface of the solidified shell of the unsolidified cast strand exceeds 0.15% per pair of the bending rollers, the amount of strain of the solidified shell may become detrimental and may cause occurrence of inner and outer cracks in the cast strand. In the present invention, therefore, the amount of strain of the solidified shell per pair of the bending rollers is limited to 0.15% or less by dispersing the strain of the solidified shell to many points with the use of plural pairs of bending rollers. With a multiple-point bending guide length of under 1m, however, it is difficult to limit the amount of strain of the solidified shell per pair of the bending rollers to 0.15% or less. If this length exceeds 4m, on the other hand, the height from the meniscus of molten steel in the mold up to the solidification completing point of the unsolidified cast strand, i.e., up to the crater top, becomes too large thus resulting in a too high static pressure of molten steel near the solidification completing point in the unsolidified cast strand. This may cause a dense center segregation and inner cracks in the interior of the cast strand, as explained previously. Said multiple-point bending guide length should therefore be in a range from 1 to 4m.

3. Constant curvature guide length

If the length of the constant curvature guide following the aforementioned multiple-point bending guide is under 35% of the length from the meniscus of molten steel in the straight mold up to the spot-strainghtening point, the curvature length of the constant curvature guide section becomes too small, this leading to a too small length from the meniscus of molten steel in the mold up to the spot-straightening point. It is practically difficult therefore to complete the solidification of the cast strand before the spot-straightening point. This too small curvature length further results in a too small radius of curvature of the constant curvature guide section, thus bringing about a too large amount of strain in the horizontal straightening of the cast strand at the spot-straightening point. This is not desirable for the quality of the cast strand. If the length of said constant curvature guide exceeds 85%, on the other hand, the overall height of the equipment becomes too high. This is not only inconvenient in equipment considerations, but also prevents a cast strand of a satisfactory quality from being obtained because the too large static pressure of molten steel near the solidification completing point in the unsolidified cast strand causes a center segregation and inner cracks, as explained in (2) above. Said length of constant curvature guide should therefore be within a range from 35 to 85% of the length from the meniscus of molten steel in the straight mold up to the spot-straightening point.

4. Draft of cast strand

C, Mn, S and other constituents are densely segregated in general in the unsolidified molten steel near the solidification completing point of a continuously cast strand and cause a dense center segregation zone at the center of the cast strand cross section. In the present invention, for the purpose of preventing said center segregation zone from occurring, a cast strand is reduced near the solidification completing point thereof by at least a pair of reduction rolls forming the tail end portion of said constant curvature guide section. If, however, the draft per pair of said reduction rolls is under 0.1%, no remarkable effect is obtained in preventing the occurrence of a center segregation zone. With a draft per pair of said reduction rolls exceeding 2.0%, in contrast, there occur inner cracks in the cast strand, and it is impossible to obtain a cast strand having a satisfactory quality. The draft per pair of said reduction rolls should therefore be within range from 0.1 to 2.0%.

5. Spot-straightening of cast strand

Substantially horizontal straightening of a cast strand at multiple point not only requires a complicated straightening system, but also necessitates difficult maintenance inspection operations. In the present invention, therefore, the cast strand reduced as in (4) above is straightened at a single point.

When a cast strand still in unsolidified state is straightened in a substantially horizontal direction at a single point, there is a fear of occurrence of inner cracks caused by the straightening strain. In the present invention, therefore, the solidification of the unsolidified cast strand is completed before the spot-straightening point.

Now, the present invention is described below more in detail with reference to the drawings:

In FIG. 1, 1 is a molten steel in an unsolidified cast strand; 1' is a solidified shell of the unsolidified cast strand; 2 is the meniscus of molten steel teemed into a straight mold 3; 4 is a vertical guide section comprising said straight mold 3 and a vertical guide roller train 4'; 5 is a multiple-point bending guide section; 6 is a constant curvature guide section comprising a constant curvature guide roller train 7' and a constant curvature reduction roll train 7; 8 is the solidification completing point of the unsolidified cast strand; 9 is a spot-straightening point; and 10 is a withdrawal/straightening roll section.

Molten steel continuously teemed into a straight mold 3 transforms into a continuously unsolidified cast strand having prescribed thickness and width while being cooled and forming a thin solidified shell 1' around it, and is guided substantially vertically downward through a vertical guide section 4 comprising said straight mold 3 and a vertical guide roller train 4' provided therebelow. Said vertical guide roller train 4' is composed of many small-diameter guide rollers so as to avoid formation of a large bulging or breakout of the thin solidified shell of the unsolidified cast strand. In preventing the formation of a large bulging or the breakout a satisfactory result is obtained by replacing part of the upper portion of the vertical guide roller group constituting said vertical guide roller train 4' by any of vertical guide plates, vertical guide rails and vertical guide lattices. The track length of said vertical guide section 4 comprising said straight mold 3 and said vertical guide roller train 4' is preferably within a range from 3 to 7m from the meniscus 2 of molten steel in said straight mold 3.

Then, the unsolidified cast strand in the vertical position is guided through a multiple-point bending guide section 5 comprising plural pairs of bending rollers, provided in succession to said vertical guide roller train 4', while the radius of curvature of said unsolidified cast strand being gradually decreased at multiple points. Said bending rollers are arranged so as to successively reduce the radius of curvature of the unsolidified cast strand for each pair of the bending rollers. Said bending rollers are provided in a number of pairs necessary for bringing the amount of strain on the inner surface of the solidified shell of the unsolidified cast strand per pair of the bending rollers to 0.15% or less. The track length of said multiple-point bending guide section 5 is preferably within a range from 1 to 4m. Since the track length of said vertical guide section 4 and that of said multiple-point bending guide section 5 are set as above in the present invention, most of inclusions contained in the molten steel in the unsolidified cast strand float up to the meniscus 2 of molten steel in the straight mold 3. Moreover, the static pressure of the molten steel in the unsolidified cast strand does not become excessively high.

Then, the unsolidified cast strand thus bent at multiple points is further guided through a constant curvature guide section 6 comprising a guide roller train 7' composed of plural pairs of guide rollers and a reduction roll train 7 composed of at least a pair of reduction rolls, provided in succession to said multiple-point bending guide section 5, and is gradually directed in the horizontal direction. The radius of curvature of said constant curvature guide section 6 is the same as that of the tail end of said multiple-point bending guide section 5. The track length of said constant curvature guide section 6 is preferably within a range from 35 to 85% of the length from the meniscus 2 of molten steel in the straight mold 3 up to a spot-straightening point 9 described later.

The unsolidified cast strand is cooled by cooling water sprayed from many nozzles (not shown) arranged between said rollers and rolls while passing through the aforementioned vertical guide section 4, multiple-point bending guide section 5 and constant curvature guide section 6, and in the meantime, its solidified shell 1' grows thicker and its molten steel 1 becomes thinner, until the solidification is completed at a solidification completing point 8. In the present invention, the teeming speed of molten steel and the cooling rate of the unsolidified cast strand are adjusted in relation to the track lengths of the guide sections mentioned above so as to complete the solidification of the cast strand before a spot-straightening point described later. Through said reduction roll train 7 comprising at least a pair of reduction rolls, forming the tail end portion of said constant curvature guide section 6, the cast strand is reduced, near the solidification completing point 8 thereof, at a draft of 0.1 to 2.0% per pair of reduction rolls.

Then, the completely solidified cast strand thus reduced and having a prescribed final cross-sectional shape is straightened in a substantially horizontal direction at a single point at the spot-straightening point 9 in a withdrawal/straightening section 10 comprising plural pairs of withdrawal/straightening rolls, provided in succession to said reduction roll train 7. Said spot-straightening point 9 is composed by a combination of at least two pairs of withdrawal/straightening rolls. In the present invention, as mentioned above, the solidification of the unsolidified cast strand is completed before said spot-straightening point 9. Therefore, because the completely solidified cast strand is straightened at said spot-straightening point 9, there is almost no fear of the occurrence of inner cracks in the cast strand caused by the straightening.

Now, the present invention is described further in detail with reference to an example:

EXAMPLE

Steel was continuously cast with the use of a continuous casting apparatus shown in FIG. 1 under the following conditions:

Steel grade of the cast strand:
C: 0.05%; Si; 0.01%; Mn; 0.3%;
P: 0.012%; S; 0.015%; Sol.Al: 0.035%
Dimensions of the cast strand: 250mm × 1,600mm
Track length of the vertical guide section 4: 5m
Track length of the multiple-point bending guide section 5 comprising six pairs of bending rollers: 1.9m
Track length of the constant curvature guide section 6: 15m (corresponding to about 70% of the length from the meniscus 2 of molten steel in the straight mold 3 to the spot-straightening point 9)
Track length of the reduction roll train 7 comprising 11 pairs of reduction rolls, forming the tail end portion of said constant curvature guide section 6: 4.5m
Draft per pair of said reduction rolls: 0.36%
Casting speed: 1.0m/min.

Figure 2:
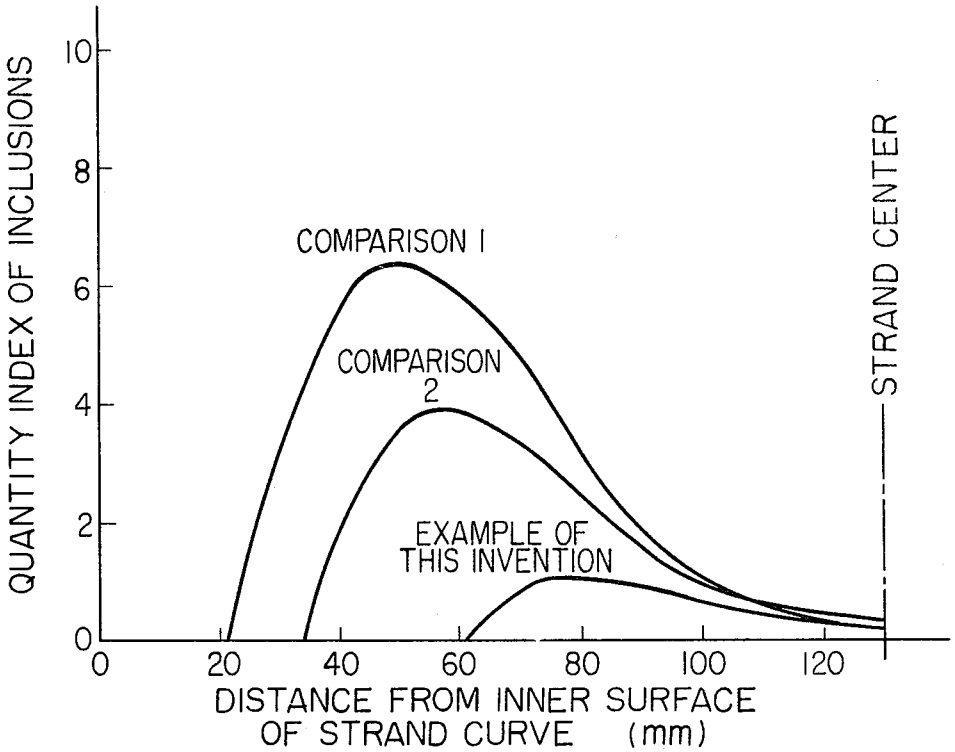
FIG. 2 gives curves representing the relation between the distance from the inner surface of curvature of a cast strand and the index showing the content of inclusions as observed in a measurement of the distribution of contents of inclusions in a completely solidified cast strand.

Measured results of the distribution of inclusions contents in this continuously cast strand in the thickness direction are shown in FIG. 2. In this figure, measured results of the distribution of inclusions contents in a strand continuously cast under the same conditions above except for the length of the vertical guide section 4 set at 1m and 2m, respectively, outside the scope of the present invention are also indicated for comparison purposes as Comparison 1 and Comparison 2 respectively.

As shown in FIG. 2, the distribution of inclusions contents is very small and the quality of the cast strand is remarkably improved in the Example within the scope of the present invention than in Comparisons 1 and 2 outside the scope of the present invention.

There was observed no inner cracks in the cast strand of the aforementioned Example within the scope of the present invention. In the cast strand bent with a pair of bending rolls at a single point in place of bending at multiple points at the multiple-point bending guide section 5, inner cracks occurred at a rate of 100 to 170 cracks/100cm$^2$ of flat area of the cast strand.

According to the present invention, as described above, inner and outer defects of a cast strand observed in the conventional continuous casting are remarkably reduced, thus permitting production of a continuously cast strand having an excellent quality and providing industrially useful effects.

We claim:

1. In a method for continuously casting steel which comprises continuously teeming molten steel into a straight mold; guiding an unsolidified cast strand with a solidified shell formed on it substantially vertically downward along a vertical guide section; then, guiding said unsolidified cast strand in the vertical position along a curved multiple-point bending guide section comprising plural pairs of bending rollers while bending said unsolidified cast strand at multiple points by successively decreasing the radius of curvature of said unsolidified cast strand for each pair of said bending rollers; then, further guiding said unsolidified cast strand thus bent at multiple points along a constant curvature guide section comprising plural pairs of guide rollers, the radius of curvature of said constant curvature guide section being the same as that of the tail end of said multiple-point bending guide section; then, reducing the cast strand, near the solidification completing point thereof by at least a pair of reduction rolls at a draft of 0.1 to 2.0% per pair of reduction rolls; and then, straightening said cast strand thus reduced in a substantially horizontal direction at a single point at a spot-straightening point;

the improvement comprising:

setting the track length of said vertical guide within a range of from 3 to 7 m from the meniscus of molten steel in said straight mold;

setting the track length of said multiple-point bending guide within a range of from 1 to 4 m;

locating said at least one pair of reduction rolls to form the tail end of said constant curvature guide section, and the track length of said constant curvature guide being within a range of from 35 to 85% of the length from the meniscus of molten steel in said straight mold up to said spot-straightening point provided in succession to said constant curvature guide section; and completing the solidification of said unsolidified cast strand within said constant curvature guide section.

2. The method of claim 1, wherein the amount of strain on the inner surface of the solidified shell of the unsolidified cast strand is not more than 0.15% per pair of said bending rollers forming said multiple-point bending guide section.

3. In an apparatus for continuously casting steel comprising:

at least a straight mold into which molten steel is continuously teemed; a vertical guide roller train comprising plural pairs of vertical guide rollers, provided directly below said straight mold, said straight mold and said vertical guide roller train forming a vertical guide section and said vertical guide section being adapted to guide an unsolidified cast strand with a solidified shell formed on it substantially vertically downward; a curved multiple-point bending guide section comprising plural pairs of bending rollers, provided in succession to said vertical guide roller train, said multiple-point bending guide section having successively decreasing radii of curvature for each of said pairs of bending rollers, and said multiple bending guide section being adapted to guide the unsolidified cast strand in the vertical position while bending said unsolidified cast strand so as to successively decrease its radius of curvature at multiple points; a constant curvature guide section comprising plural pairs of guide rollers, provided in succession to said multiple-point bending guide section, the radius of curvature of said constant curvature guide section being the same as that of the tail end of said multiple-point bending guide section, said constant curvature guide section being adapted to guide said cast strand bent at said multiple-point bending guide section and including at least one pair of reduction rolls, said at least one pair of reduction rolls being adapted to reduce the cast strand, near the solidification completing point thereof, at a draft of 0.1 to 2.0% per pair of said reduction rolls; and a withdrawal/straightening roll section comprising plural pairs of withdrawal/straightening rolls, provided in succession to said constant curvature guide section, at least two pairs of said withdrawal/straightening rolls of said withdrawal/straightening roll section forming a spot-straightening point, said spot-straightening point being adapted to straighten the cast strand reduced by said reduction rolls at a single point in a substantially horizontal direction;

the improvement wherein:

the track length of said vertical guide section is within a range of from 3 to 7m from the meniscus of molten steel in said straight mold;

the track length of said multiple-point bending guide section is within a range of from 1 to 4m;

said at least one pair of reduction rolls forming the tail end of said constant curvature guide section; and the track length of said constant curvature guide section is within a range of from 35 to 85% of the length from the meniscus of molten steel in said straight mold up to said spot-straightened point.

4. The apparatus of claim 3, wherein part of the upper portion of said vertical guide roller train comprises vertical guide plates.

5. The apparatus of claim 3, wherein part of the upper portion of said vertical guide roller train comprises vertical guide rails.

6. The apparatus of claim 3, wherein part of the upper portion of said vertical guide roller train comprises vertical guide lattices.

* * * * *